US005791216A

United States Patent [19]

Hada et al.

[11] Patent Number: 5,791,216

[45] Date of Patent: Aug. 11, 1998

[54] CUTTING CONTROL METHOD

[75] Inventors: Masahide Hada; Masahiko Maeue, both of Wakayama, Japan

[73] Assignee: Shima Seiki Manufacturing Limited, Wakayama, Japan

[21] Appl. No.: 727,368

[22] Filed: Oct. 8, 1996

[30] Foreign Application Priority Data

Oct. 9, 1995 [JP] Japan ..... 7-261900

[51] Int. Cl.[6] ..... B26D 5/00

[52] U.S. Cl. ..... 83/13; 83/34; 83/49; 83/76.6; 83/940

[58] Field of Search ..... 83/13, 34, 49, 83/52, 76.1, 76.6, 76.7, 76.8, 76.9, 939, 940, 941, 56

[56] References Cited

U.S. PATENT DOCUMENTS 4,462,292 7/1984 Pearl ..... 83/471.2
4,643,061 2/1987 Gerber ..... 83/941 X

FOREIGN PATENT DOCUMENTS 7136983 5/1995 Japan .
7246594 9/1995 Japan .
2175828 12/1986 United Kingdom .

*Primary Examiner*—Eugenia Jones
*Attorney, Agent, or Firm*—Baker & Botts, L.L.P.

[57] ABSTRACT

A sheet material 2 is cut with a round blade 10 and a notching blade 11. It is assumed that, in a straight section P1–P2–P3–P4, a distance between the end point P1 and the end point P2 is not shorter than a blade width W10 of the round blade 10, a distance between the end point P2 and the end point P3 and a distance between the end point P3 and the end point P4 are shorter than the blade width W10 and it is necessary to cut without cutting into a pattern piece indicated by shadow. A section between the end point P2 and the end point P3 can be cut without cutting into the pattern piece although overcut occurs on the end point P2 side, with the round blade 10 by aligning the leading edge thereof at the end point P3. A section between the end point P3 and the end point P4 is cut with the notching blade 11 because cutting with the round blade 10 causes a cut into the pattern piece at least from one of the end points.

6 Claims, 7 Drawing Sheets

CUTTING CONTROL METHOD

BACKGROUND OF THE INVENTION

1. Field of the Invention

The present invention relates to a method for controlling cutting of sheet material such as woven fabric according to cutting data, particularly to a method for controlling cutting with use of a round blade.

2. Description of the Related Art

Conventionally, cutting machines which cut a sheet material 2 by rotating a round blade 1 as shown in FIGS. 9 and 10 have been used. In addition to the cutting machines in which the round blade 1 is used as a cutting blade, there are cutting machines in which a straight blade, which moves reciprocatingly, is used as a cutting blade. In the case of cutting the sheet material 2 with the round blade 1, configuration of a cutting head can be simplified and reduced in size and weight compared to the case of cutting with a straight reciprocating blade. Cutting speed of moving the cutting head along a cutting line is also increased, although there is a limitation to the thickness of the sheet material to be cut and it is not possible to cut a stack of many sheets. Therefore, a cutting machine having a round blade is suited to test manufacture or small-volume production rather than mass production.

FIG. 9 shows a configuration disclosed in U.S. Pat. No. 4,462,292 as an example of typical prior art. The sheet material 2 is spread over a hard surface of a cutting table 3, and is cut with the round blade 1 which is in a condition of near point contact. This means that a blade width W1 of the round blade 1 is far smaller than diameter D1 of the round blade 1 (D1>>W1). In this prior art, in addition to the round blade 1 which cuts along a cutting line indicated by cutting data, a notching blade for making a notch at right angles to the cutting line is mounted on the cutting head.

FIG. 10 shows a configuration where a soft base sheet 4 is interposed between the sheet material 2 and the surface of the cutting table 3, and the sheet material is cut by making the round blade 1 penetrate to a depth d. A blade width W2 of the round blade 1 in this case becomes significantly greater than the blade width W1 of FIG. 8 even when the diameter D1 of the round blade 1 is the same (D1>W2>W1). As a result, a straight section whose length is less than the blade width W2 cannot be properly cut while restricting the cut within the section. In order to cut out a pattern piece having such a straight section from the sheet material 2 with the round blade 1, over-cutting of a portion beyond the straight section cannot be avoided.

Prior art process for avoiding an excessive overcut which reaches a pattern piece is disclosed in, for example, Japanese Unexamined Patent Publication JP-A 7-136983(1995) and JP-A 7-246594 (1995). In either of these prior arts, a round blade is not employed as a cutting blade and the tips of the cutting blades used in these prior arts are provided with an inclination relative to the sheet surface. With the method disclosed in Japanese Unexamined Patent Publication 7-136983, a sign of the total turning angle when the entire periphery enclosing a pattern piece is traced around and a sign of intersecting angle at the end point of the straight sections constituting the periphery are used to determine whether a cut is out of the pattern piece or not when overcut is carried out at the end point. Overcut is made only when the cut falls out of the pattern piece thereby enabling reliable cut-out of pattern piece without cutting inside the pattern piece. With the method disclosed in Japanese Unexamined Patent Publication JP-A 7-246594 (1995), both ends of a straight section are cut in advance with a second cutting blade, which has a blade width less than that of a main first cutting blade and is less likely to cut at wrong positions, then the mid portion of the straight section is cut with the first cutting blade, thereby eliminating the overcut which is otherwise required for certain cut-out at end points.

In the prior art of U.S. Pat. No. 4,462,292 as shown in FIG. 9, the sheet material 2 is spread over a cutting table 3 which has a hard plate on the surface so that the round blade 1 does not cut into the sheet material 2 too deep, thereby preventing the blade width W1 from becoming larger. However, because the round blade 1 is required to cut into the hard plate slightly, the blade edge tends to wear.

With the prior art disclosed in Japanese Unexamined Patent Publication JP-A 7-136983 or 7-246594, although overcut is controlled by using a cutting blade having a blade width less than the straight section to be cut, it cannot be applied to such a case where a straight section less than the blade width W2 is to be cut by using the round blade 1 having the relatively large blade width W2 as shown in FIG. 9.

SUMMARY OF THE INVENTION

An object of the invention is to provide a cutting control method capable of efficient cutting by using a round blade and a cutter having a blade width less than that of the round blade.

The invention provides a cutting control method in which a round blade which has a rotation shaft disposed in parallel with a surface of a cutting table and conducts cutting by penetrating the circumferential cutting edge thereof into the sheet, and a cutter which cuts with a blade having a blade width less than that of the round blade are selectively used to cut a sheet material spread over the surface of the cutting table, the method comprising the steps of:

when a pattern piece to be cut out has a straight section, determining whether the length of the straight section is not less than the blade width of the round blade during cutting;

selecting the round blade, when the length of the straight section is not less than said blade width, or when a predetermined condition to allow overcut is satisfied though the length of the straight section is less than said blade width; and selecting the cutter when the length of the straight section is less than said blade width and the predetermined condition to allow overcut is not satisfied.

According to the invention, although the blade width becomes relatively broad since the sheet material is cut with the round blade under the condition of the circumferential edge penetrating the sheet material, efficient cutting with the round blade is enabled in case the length of a straight section to be cut is not less than the blade width and in case the length is less than the blade width but overcut is allowed. Sections shorter than the blade width of the round blade can be cut by using the cutter.

The invention is characterized in that the condition to allow overcut is that the overcut does not reach the pattern piece to be cut out from the sheet material, and whether the condition is satisfied or not is determined on the basis of the position of the pattern piece in relation to a cutting direction specified in advance.

According to the invention, since cutting operation with the round blade is carried out after making sure on the basis of the position of the pattern piece in relation to a cutting direction specified in advance that an overcut does not reach the pattern piece, quick cutting operation is made possible without damaging the pattern piece.

The invention is characterized in that said condition that an overcut does not reach the pattern piece is satisfied, by aligning the leading edge of the blade width at the end point of the straight section in the case where the cutting direction changes to the pattern piece side in the previous straight section than an extension of the previous straight section, and by aligning the tail edge of the blade width with the start point of the straight section in the case where the cutting direction changes to a side in the previous straight section, which is not the pattern piece side, than the extension of the previous straight section, and where the next cutting direction changes to the pattern piece side in the current straight section than an extension of the current straight section.

According to the invention, when the cutting direction changes, it can be determined which of the leading edge and the tail edge of the blade width should be aligned with the end point or start point of the straight section based on whether the cutting direction changes to the pattern piece side in the straight section prior to the change.

The invention is characterized in that a curved section having a section length less than a predetermined length and a radius of curvature less than a predetermined radius of curvature is cut with said cutter.

According to the invention, since in addition to the round blade having a large blade width in cutting, the cutter having a blade width less than that of the round blade is provided, curved sections of small radii of curvature which are difficult to cut with the round blade can be also easily cut with the cutter.

According to the invention, as described above, a sheet material is cut out with the round blade in such a condition that the circumferential cutting edge is penetrating. Although the blade width becomes relatively large, efficient cutting with the round blade is enabled in case the length of a straight section to be cut is not less than the blade width and in case the length is less than the blade width but overcut is allowed. Sections shorter than the blade width of the round blade can be cut with the cutter without causing an excessive cut.

Further according to the invention, efficient cutting is enabled in a state where an overcut does not reach the pattern piece to be cut out from the sheet material.

Further according to the invention, it can be determined which of the leading edge and the tail edge of the blade width should be aligned with the end point of the straight section when the cutting direction changes. Since overcut does not occur at the aligned position, an excessive cut into the pattern piece can be prevented.

Further according to the invention, it is made possible to easily cut, with the cutter, curved sections of small radii of curvature which are difficult to cut with the round blade having a larger blade width in cutting.

BRIEF DESCRIPTION OF THE DRAWINGS

Other and further objects, features, and advantages of the invention will be more explicit from the following detailed description taken with reference to the drawings wherein.

DETAILED DESCRIPTION OF THE INVENTION

Figure 1A:
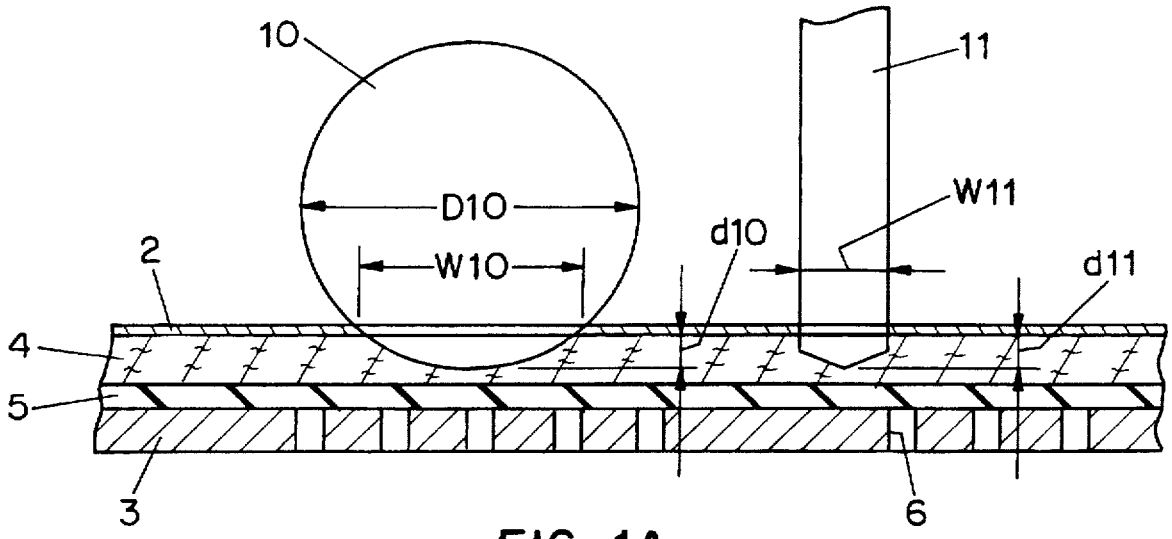
FIG. 1A is a schematic side view showing the basic concept of one embodiment of the invention.

Now referring to the drawings, preferred embodiments of the invention are described below.

Figure 1B:
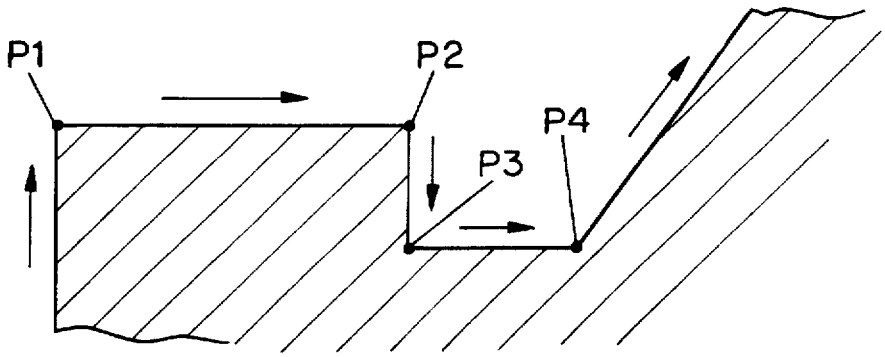
FIG. 1B is a plan view of FIG. 1A.

FIGS. 1A and 1B show the basic concept of cutting control method in one embodiment of the invention. As shown in FIG. 1A, a sheet material 2 is spread over a surface of a cutting table 3, with a base sheet 4 interposed between the sheet material 2 and the cutting table 3. The base sheet 4 is air-permeable and is placed on an air-permeable conveyor belt 5. The cutting table 3 has a number of vent holes 6 formed in the surface thereof, so that the sheet material 2 can be held by vacuum suction. The sheet material 2 is cut by means of a round blade 10 and a notching blade 11 which is used as another cutter. The round blade 10 is made to penetrate into the base sheet 4 to a depth of d10, and therefore the round blade 10 has a relatively large blade width W10 compared to a diameter D10 thereof (D10>W10). For example, the blade width W10 is about ½ inches. The notching blade 11 which is a cutter having a blade width W11 smaller than the blade width W10 is provided for cutting a notch in the sheet material 2 at right angles to the cutting line. The notching blade 11 is also made to penetrate into the base sheet 4 to a depth of d11. When spreading the sheet material 2 over the cutting table 3 and when discharging the sheet material 2 after cutting, the conveyor belt 5 is driven to move. The base sheet 4 also moves as the conveyor belt 5 moves. The base sheet 4, after being used for a certain period of time, is replaced as a consumable part. As the cutter, a cloth cutting knife or another type of cutting tool other than the notching blade 11 may also be used.

FIG. 1B shows an example of cutting pattern wherein the notching blade 11 is used in addition to the round blade 10 of FIG. 1A. In a straight section P1–P2–P3–P4, it is assumed that a length between end point P1 and end point P2 is not less than the blade width W10 of the round blade 10, a length between end point P2 and end point P3 and a length between end point P3 and end point P4 are less than the blade width W10, while cutting must be done without cutting into a pattern piece to be cut out, which is indicated by shadow. In the section between end point P2 and end point P3, overcut occurs on the end point P2 side when cutting with the round blade 10 by aligning the leading edge at the end point P3, although the overcut does not reach the pattern piece. In the section between the end point P3 and the end point P4, when cutting with the round blade 10, it cannot be avoided that a cut reaches the pattern piece through at least one of the end points. Therefore cutting is carried out with the notching blade 11.

Figure 2:
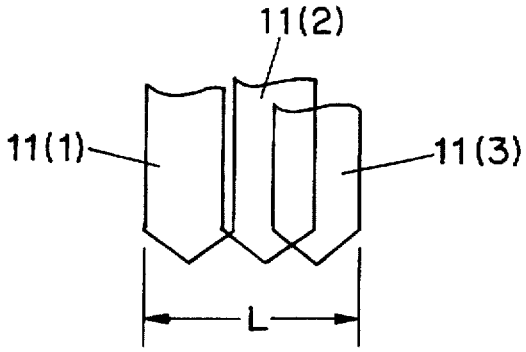
FIG. 2 is a schematic side view showing a state of using a notching blade in the embodiment of FIG. 1.

FIG. 2 shows a state of cutting a section of a length L by using the notching blade 11. The notching blade 11 having the blade width W11 is shifted while partially overlapping as indicated by 11 (2), 11 (2) and 11 (3), thereby cutting the sheet so that the length becomes L as a whole.

Figure 3:
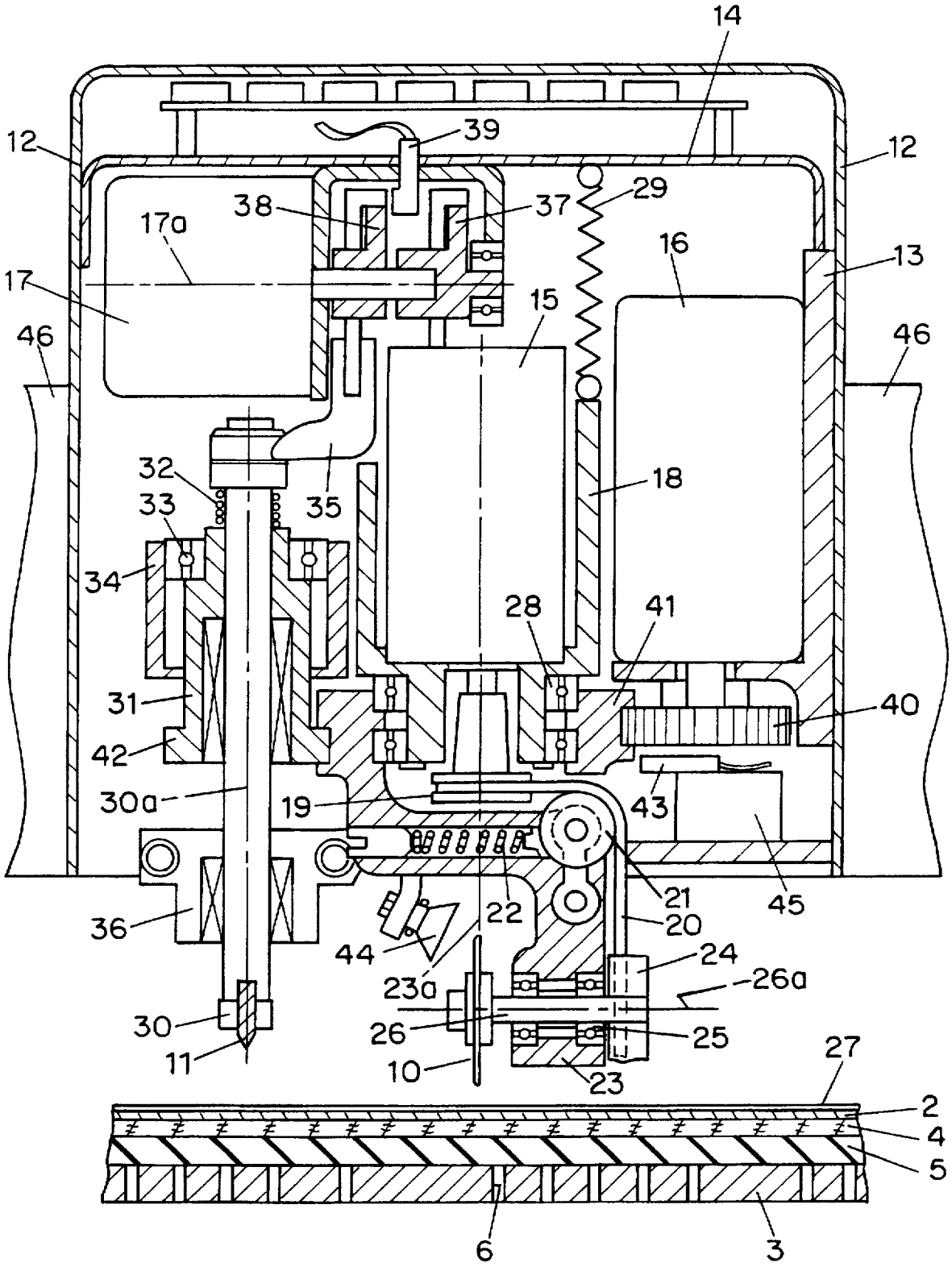
FIG. 3 is a front sectional view showing the configuration of a cutting head used in the embodiment of FIG. 1.

FIG. 3 shows a schematic configuration of a cutting head 12 of the cutting machine provided with the round blade 10 and the notching blade 11. The cutting head 12 cuts the sheet material 2 while moving over the rectangular cutting table 3 whereon the sheet material 2 is spread and held in position by vacuum suction or the like, according to cutting data with X and Y directions set along the longer side and shorter side of the table, respectively. Housed in the cutting head 12 is a base 13, and a control circuit 14 is housed above the base 13. Also housed in the cutting head 12 are three motors: a round blade motor 15, an angular displacement servo motor 16 and a cam motor 17. The angular displacement servo motor 16 and the cam motor 17 are fixed on the base 13. The round blade motor 15 is mounted on a holder 18 which is movable in Z-axis direction perpendicular to the cutting table 3 surface, namely vertically, relative to the base 13.

Mounted at the tip of a rotary shaft extending downward from the round blade motor 15 is a drive pulley 19. Wound around the drive pulley 19 is a flat belt 20 in a plane perpendicular to the axial line. The flat belt 20 is changed in the direction vertically by an adjust pulley 21. The adjust pulley 21 presses the flat belt 20 with the force of an adjust spring 22 thereby to give a tension to the belt. Mounted at the tip of an angular displacement member 23 downward from a position whereon the adjust pulley 21 and the adjust spring 22 are mounted is a driven pulley 24 whereon the flat belt 20 is wound. The driven pulley 24 is mounted at one end of a rotary shaft 26 which is pivotally supported by a bearing 25. Mounted on another end of the rotary shaft 26, of which axial line 26*a* is parallel to the surface of the cutting table 3, is the round blade 10 at a position on angular displacement axial line 23*a* of the angular displacement member 23 so that the diameter in the vertical direction agrees, and cuts the sheet material 2 by the rotation of the rotary shaft 26. The diameter of the drive pulley 19 is larger, two times for example, than the diameter of the driven pulley 24. With this configuration, when the round blade motor 15 is run at about 3000 rpm, the round blade 10 is driven to rotate at 6000 rpm. At such a revolutionary speed as this, running noises become excessive in case the driving force is transmitted through a gear mesh. Use of the flat belt 20 enables it to transmit the driving force quietly. Decreasing the diameter of the driven pulley 24 makes it possible to bring the round blade 10 nearer to the base sheet 4. Slippage can be prevented by increasing the width of the flat belt 20. In order to cut with the round blade 10 surely even when the sheet material 2 is air-permeable, it is preferable to cover the surface of the sheet material 2 with a thin plastic sheet having air-impermeability, for example a vinyl sheet 27.

Interposed between the holder 18 and the angular displacement member 23 is a roller bearing 28 enabling smooth relative angular displacement. The holder 18 and the angular displacement member 23 make consolidated displacement in Z-axis direction. In order to reduce the combined weight by suspending it, a balancing spring 29 is installed. Instead of the balancing spring 29, such a configuration as a balance weight is suspended via a pulley may also be employed.

Cutting of the sheet material 2 with the round blade 10 is carried out by causing the cutting edge to cut into the base sheet 4 to a certain depth. Thickness of the base sheet 4 is required to be at least twice the penetration depth of the cutting edge. Diameter of the round blade 10 is 1 inch, for example, which cuts through the sheet material 2 of a thickness about one half of the diameter. A straight section of cutting line shorter than this cutting blade width must be cut, not with the round blade 10, but with the notching blade 11 having a blade width within half the diameter of the round blade.

The notching blade 11 is mounted on a chuck 30 and can be replaced with one having a different blade width and/or a different edge shape as required. Mounted on the shaft upward of the notching blade 11 is a ball spline 31 for angular displacement of the notching blade 11 around axial line 30*a* while allowing displacement in the direction of the axial line 30*a* by means of an oil retaining bearing. Above the ball spline 31, a shaft portion of the notching blade 11 is forced downward by a notching blade spring 32. Upper portion of the ball spline 32 is supported via a bearing 33 by a holder 34 which is fixed on the base 13. The notching blade 11 receives lifting force transmitted via an arm 35 to the upper end thereof. Mounted downward of the shaft of the notching blade 11 is a bearing 36 which enables vertical displacement of the notching blade 11 by means of an oil retaining bearing.

The cam motor 17 is constituted of a stepping motor, for example, and causes the round blade cam 37 and the notching blade cam 38 to make angular displacement about the axial line 17*a*. A reference position of each cam is detected by a cam home position sensor 39. The round blade cam 37 causes the holder 18 and the angular displacement member 23 to make vertical displacement along the angular displacement axial line 23*a*. The notching blade cam 38, via the arm 35, causes the notching blade 11 to make vertical displacement along the axial line 30*a*. Vertical displacement of the round blade 10 by the round blade cam 37 and vertical displacement of the notching blade 11 by the notching blade cam 38 are selected according to the direction of angular displacement of the cam motor 17. That is, cams are made in such shapes as, when the motor makes angular displacement to one side, the other side is made to wait at the top position.

Mounted at the tip of the output shaft of the angular displacement servo motor 16 is a drive gear 40, which is in mesh with a driven gear 41 for the round blade formed in an upper portion of the angular displacement member 23. The driven gear 41 is formed to be thicker in the direction of angular displacement axial line 23*a*, and maintains meshing relation even during vertical displacement. The driven gear 41 for the round blade meshes also with a driven gear 42 for notching blade. Installed below the cutting head 12 are an angular home position sensor 43 which detects whether the driven gear 41 for the round blade is at the reference angular position or not, a grinding wheel 44 for grinding the round blade 10 and a solenoid 45 which drives the grinding wheel 44 to make contact with the round blade 10 or depart therefrom. The cutting head 12 is installed on a beam 46 that moves in X-axis direction on the cutting table 3, and can move in the longitudinal direction thereof, namely Y-axis direction.

Figure 4:
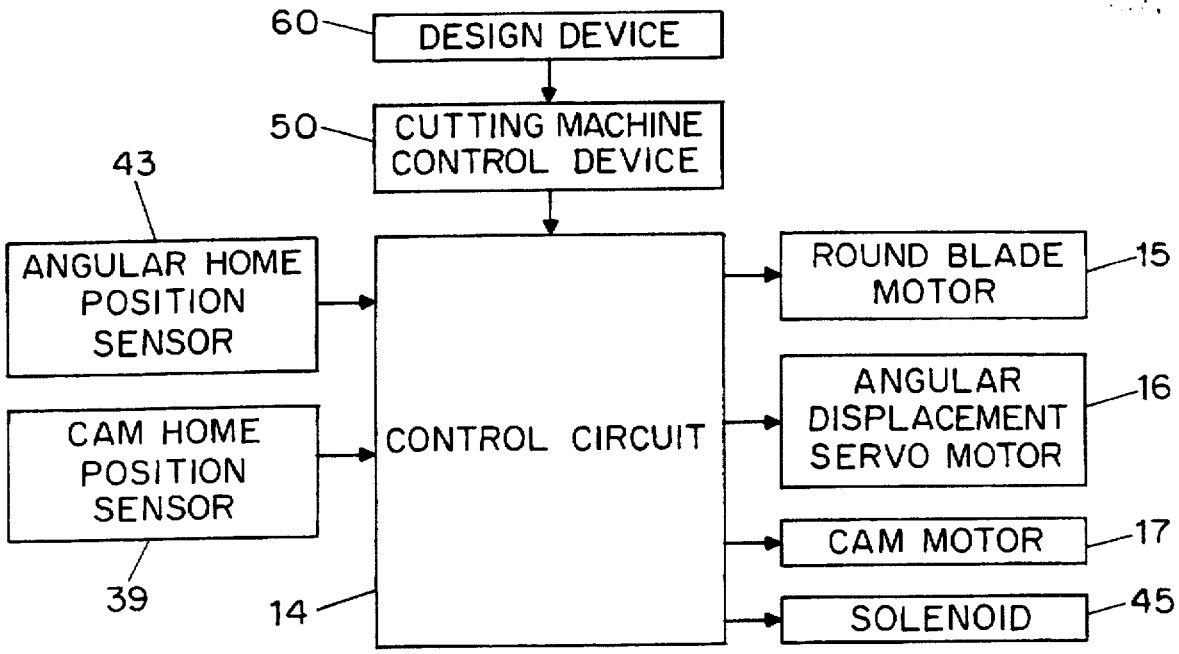
FIG. 4 is a block circuit diagram showing the electrical configuration of the cutting head of FIG. 3.

FIG. 4 shows the electrical configuration related to the cutting head 12 of FIG. 3. A control circuit 14 includes a microcomputer and other components, and drives the round blade motor 15, the angular displacement servo motor 16, the cam motor 17 and the solenoid 45 in response to the output from the angular home position sensor 43 and the cam home position sensor 39. Orientations of the round blade 10 and the notching blade 11 are changed through servo control by using the angular displacement servo motor 16 in common, and one of these blades is selected by the cam motor 17. Movement of the cutting head 12 in X-axis direction and Y-axis direction is controlled by a cutting machine control device 50 installed on the cutting machine. The cutting machine control device 50 receives the cutting data fed thereto on-line from a design device 60, or off-line via a recording medium such as a floppy disk. The cutting data is prepared by the design device 60 constituted of a CAD system or the like, and specifies what pattern piece is to be cut out the sheet material 2. When switching between the round blade 10 and the notching blade 11, difference in the arrangement at the cutting head 12 is corrected.

Figure 5A:
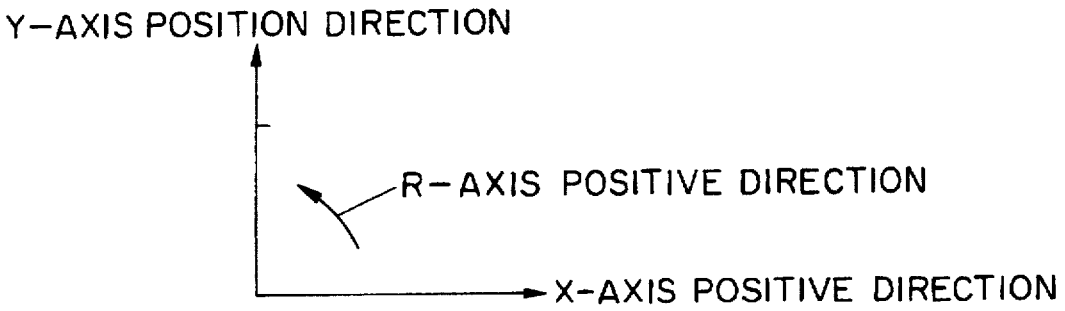
FIG. 5A is a drawing showing the relationship between X-axis, Y-axis and R-axis of cutting data in the embodiment of FIG. 1.
Figure 5B:
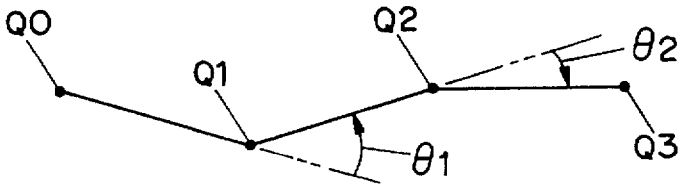
FIG. 5B is a drawing showing a process of calculating a relative angle in the embodiment of the invention.

FIG. 5A shows the direction of R-axis which is the orientation of the round blade 10 and the notching blade 11 relative to the plane defined by X-axis and Y-axis. R-axis is assumed to be positive in the counter-clockwise direction. FIG. 5B shows the method of calculating a relative angle which is a change in the angle for each straight section of cutting. Assume that a section between end point Q1 and end point Q2 is the section to be cut now, namely the current section from start point Q1 to end point Q2. Present relative angle $\theta 1$ is assumed to be the angle between an extended line of the previous section from start point Q0 to end point Q1 which has been cut previously and the current section. The next relative angle $\theta 2$ is assumed to be the angle between an extended line of the current section and the section from the start point Q2 to the end point Q3 which is to be cut next. Such a relative angle $\theta$ is assumed to be in a range of $0° < |\theta| < 180°$, with the sign defined similarly to that of R-axis of FIG. 5A. For example, in case the relative angle $\theta$ is positive when a pattern piece exists on the left side of the cutting line, the previous section is assumed to be extended and cutting proceeds to the side where the pattern piece exists.

Figure 6A:
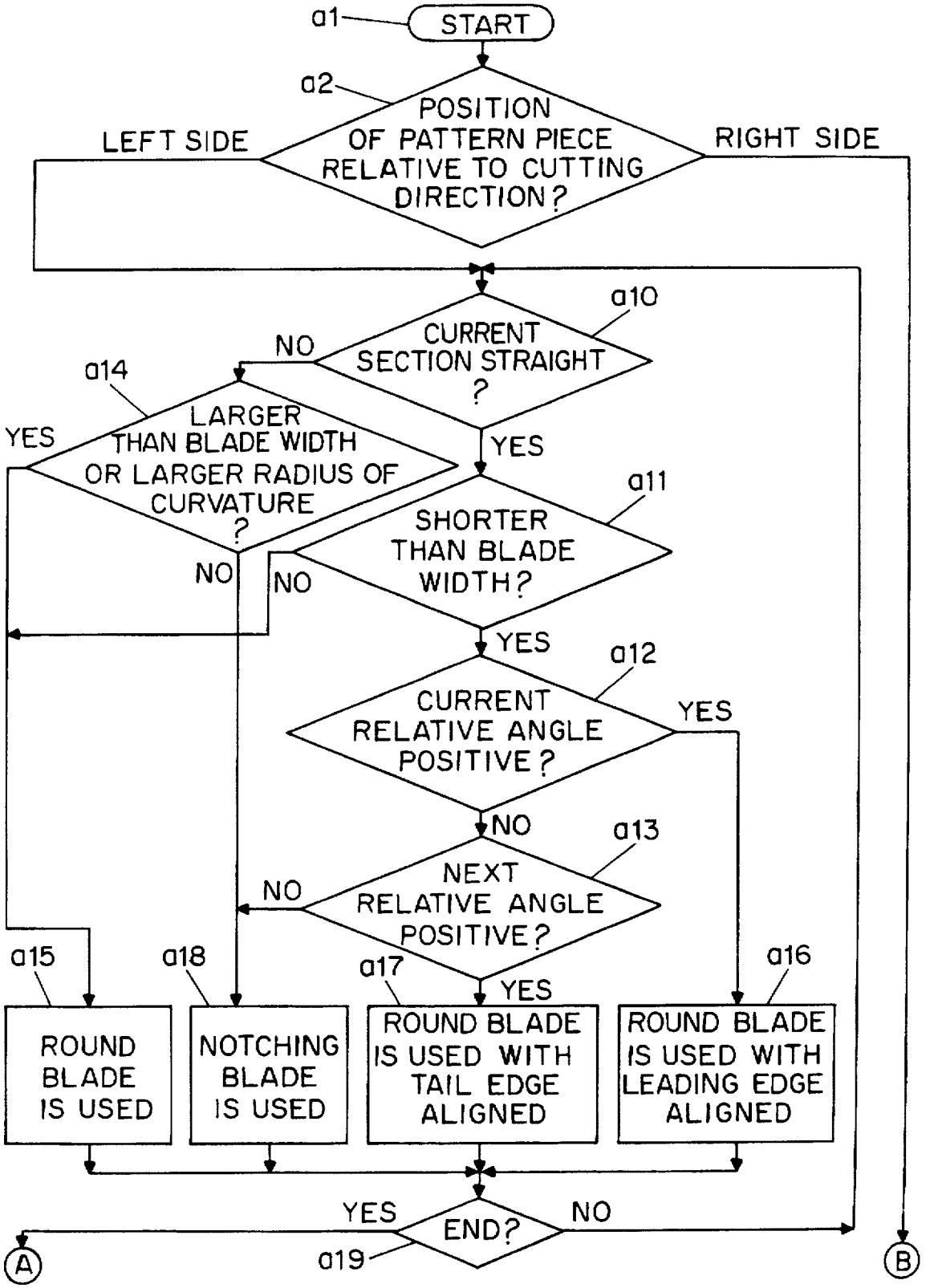
FIG. 6 is a flow chart showing the operation of the embodiment of FIG. 1.
Figure 6B:
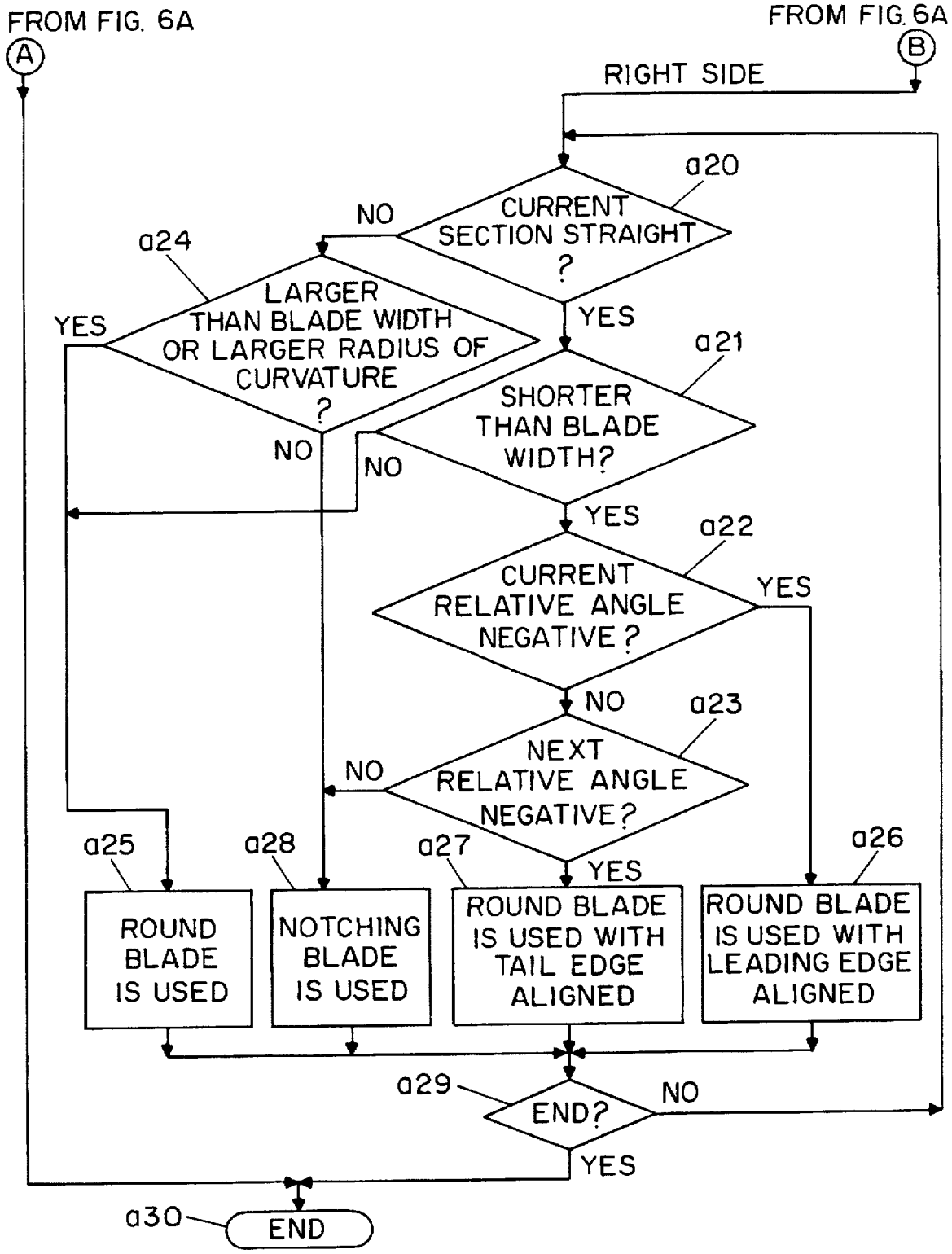

FIG. 6 shows the operation of this embodiment in the case of cutting one pattern piece. Cutting operation starts in step a1 and it is determined in step a2 whether the position of the pattern piece is on the left side or the right side. A position of the pattern piece is specified together with the cutting direction by the design device 60 of FIG. 4.

When the pattern piece is on the left side, it is determined whether the current section is straight or not in step a10. In case the section is straight, it is determined in step all whether its length is less than the blade width W10 of the round blade 10. When the length is less than the blade width W10, it is determined in step a12 whether the current relative angle is positive or not. When it is not positive, it is determined in step a13 whether the next relative angle is positive or not. Decision on whether the section is straight or not will be described later.

In case it is determined in step a10 that the current section is not straight, it is determined in step a14 whether the section length or the radius of curvature is larger than the reference or not. When it is determined in step a14 that the section length or the radius of curvature is larger than the reference, or when it is determined in step all that the section is not shorter than the blade width, cutting operation is carried out by using the round blade 10 in step a15. When the current relative angle is positive in step a12, leading edge of the round blade 10 is moved to the end point of the section in step a16. When it is determined that the next relative angle is positive in step a13, cutting operation is carried out by aligning the tail edge of the round blade 10 at the start point of the section in step a17. When it is determined in step a13 that the next relative angle is not positive, cutting operation without overcutting is carried out in step a18 by using the notching blade 11. When cutting operations in steps a15 through a18 are completed, it is determined whether cutting out of the pattern piece is completed or not in step a19. In case there remains a section to be cut, the process returns to step a10.

The operation when it is determined in step a2 that the pattern piece is positioned on the right side is carried out in steps a20 through a29. Because the operations in these steps are basically similar to those in steps a10 through a19, respectively, description thereof will be omitted. In step a22 and step a23, however, the portion where the relative angle is determined to be positive in the corresponding steps a12 and a13 is changed to negative. This is because, when the pattern piece is on the right side of the cutting line and the relative angle is negative, cutting operation proceeds toward the side where the pattern piece exists in case it is assumed that the previous pattern piece continues, similarly to the case where the pattern piece is on the left side and the relative angle is positive.

In case it is determined in step a19 or step a29 that there is no pattern piece remaining, the operation is completed in step a30. Because a plurality of pattern pieces are generally cut out from the sheet material 2, the operations of step a1 through step a30 are repeated by the number of the pattern pieces. The operations described above are carried out in the cutting machine control device 50 or the design device 60 of FIG. 4.

Figure 7A:
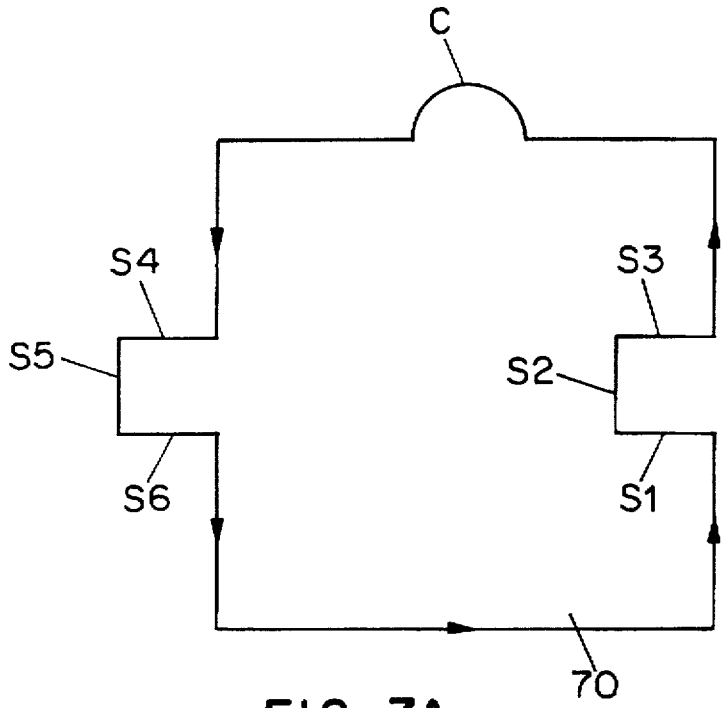
FIG. 7A is a schematic drawing showing an example of a pattern piece cut out according to the operation of FIG. 6.
Figure 7B:
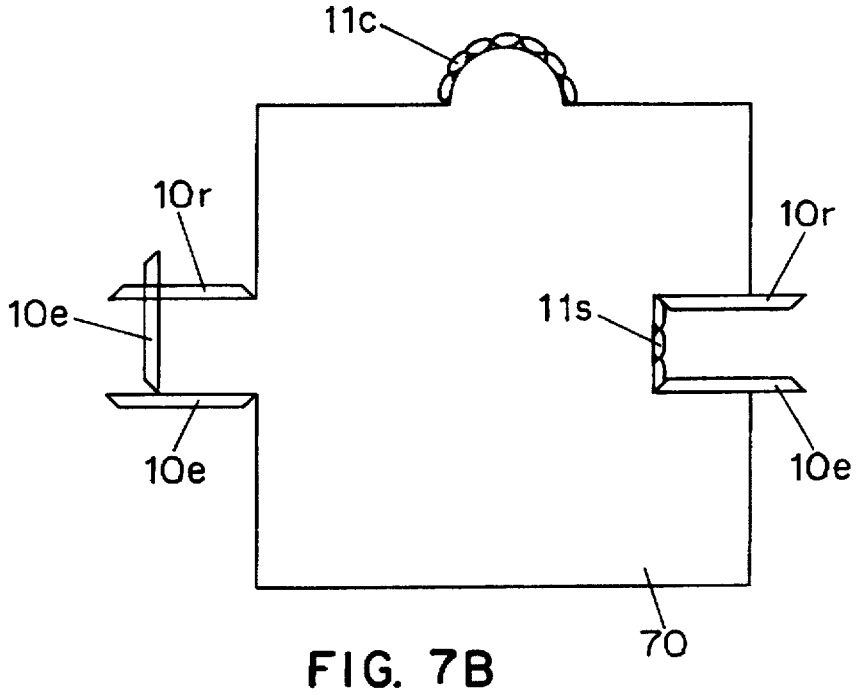
FIG. 7B is a schematic drawing showing a state of cutting out the pattern piece of FIG. 7A.

FIGS. 7A and 7B show examples of a pattern piece to be cut out in the operation shown in FIG. 6. As shown in FIG. 7A, cutting line on the periphery of a pattern piece 70 includes straight sections S1 through S6 which are shorter than the blade width W10 of the round blade 10 and the curved section C. Among these, sections S1, S5 and S6 are cut by means of the round blade 10 with the leading edge being aligned in step a12 through step a16. Sections S3 and S4 are cut by means of the round blade 10 with the tail edge thereof being aligned in step a13 through step a17. The section S2 is cut by using the notching blade 11 in step a13 through step a18. FIG. 7B schematically shows a state of cutting with the round blade 10 and the notching blade 11 in the operation shown in FIG. 6. States of aligning the leading edge and tail edge of the round blade 10 at the end point and the start point are indicated by 10*e* and 10*r*, respectively. Cutting of a straight section with the notching blade 11 is indicated by 11*s*.

The curved section C shown in FIG. 7A can be cut with the notching blade 11 while changing its direction little by little. In FIG. 7B, the state of cutting such a curved section is indicated by 11*c*. As long as overcut is allowed, pattern pieces can be cut out quickly by using the round blade 10, improving the availability factor of the cutting machine.

Figure 8:
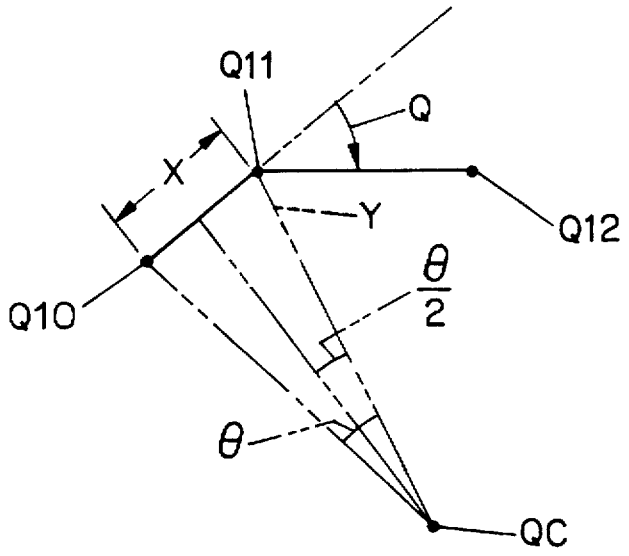
FIG. 8 is a drawing showing the handling of a curved section in the embodiment of FIG. 1.
Figure 9:
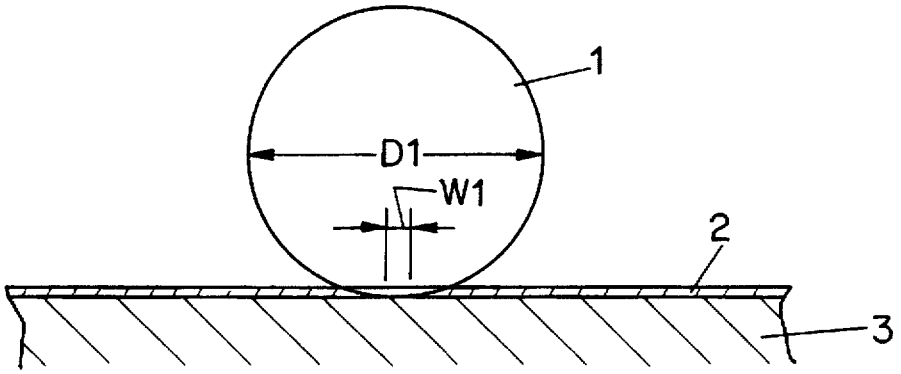
FIG. 9 is a schematic side view showing the configuration of prior art.
Figure 10:
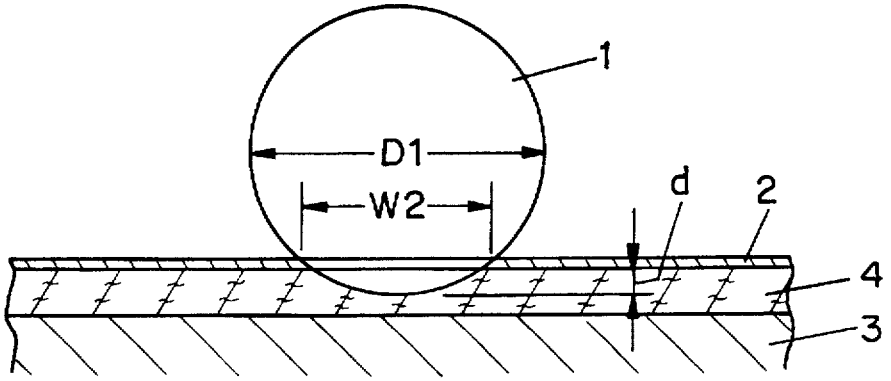
FIG. 10 is a schematic side view showing the configuration of prior art.

FIG. 8 shows the process of determining whether a section is straight or not, and determining the radius of curvature of a curved section. The current section from start point Q10 to end point Q11 having a length x is assumed. The next relative angle is assumed to be $\theta$. In case the next relative angle $\theta$ is an acute angle ($0° < \theta < 90°$), smaller than a specified angle of 30° for example, and x is shorter than a specified length which is set to about 4 to 5 times the blade width during cutting with the round blade 10, for example, it is determined that the current section is curved. Because the center of curvature is located on the perpendicular bisector of a line pattern piece connecting the start point Q10 and the end point Q11 at a position where the apical angle is θ, radius y which is the distance between the center QC and the end point Q10 or Q11 is given by the following equation.

$$y = \frac{x/2}{\sin\theta/2} \quad (1)$$

When cutting curved sections having small radii of curvature with the round blade 10, the following problems occur.

1) Cutting into the pattern piece being cut out or into the adjacent pattern piece with the tail edge of the blade when changing the blade orientation, because the blade width in cutting is large.
2) The sheet material 2 is lifted off when changing the blade orientation.

Therefore, the notching blade 11 is used when the section length is within the reference and the radius of curvature is within the reference, as shown in step a14 and step a24 of FIG. 6. A reference for the length of section is the blade width of the round blade 10, for example, and a reference for the radius of curvature is about ⅓ of the specified length, namely from about ⅔ to ⅔ of the blade width, for example.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A cutting control method in which a round blade which has a rotation shaft disposed in parallel with a surface of a cutting table and conducts cutting by penetrating a circumferential cutting edge thereof into a sheet material, the round blade having a round blade width, and a cutter which cuts having a cutter blade width smaller than that of the round blade width are selectively used to cut the sheet material spread over the surface of the cutting table, the method comprising the steps of:

when a pattern piece to be cut out has a straight section having a length, determining whether the length of the straight section is not less than the round blade width;

selecting the round blade, when the length of the straight section is not less than said round blade width, or when a predetermined condition to allow overcut is satisfied though the length of the straight section is less than said round blade width; and selecting the cutter when the length of the straight section is less than said round blade width and said predetermined condition to allow overcut is not satisfied.

2. The cutting control method of claim 1, wherein said condition to allow overcut is that the overcut does not reach the pattern piece to be cut out from the sheet material, and whether said condition is satisfied or not is determined on the basis of the position of the pattern piece in relation to a predetermined cutting direction.

3. The cutting control method of claim 2, wherein the round blade width has a leading edge and a tail edge determined by a cutting direction, and wherein determining said condition that an overcut does not reach the pattern piece further comprises the steps of:

determining whether an angle of a first cutting direction having start and end points is positive, with positive being an angular rotation in the direction of the pattern piece relative to the predetermined cutting direction;

determining whether an angle of a second cutting direction having start and end points immediately following the first cutting direction is positive;

selecting the round blade and aligning the leading edge of the round blade with the start point of the first cutting direction when the angle of the first cutting direction is positive; and selecting the round blade and aligning the tail edge of the round blade with the start point of the first cutting direction when the angle of the first cutting direction is negative and the angle of the second cutting direction is positive.

4. The cutting control method of claim 1, wherein a curved section having a section length shorter than a predetermined length and a radius of curvature less than a predetermined radius of curvature is cut with said cutter.

5. The cutting control method of claim 4, wherein the predetermined length is the round blade width and the predetermined radius of curvature is in a range from ⅔ to ⅔ the round blade width.

6. The cutting control method of claim 4, wherein said curved section is cut while a direction of the cutter is gradually changed.

* * * * *